US006053139A

United States Patent [19]

Eguchi et al.

[11] Patent Number: 6,053,139

[45] Date of Patent: Apr. 25, 2000

[54] VALVE TIMING CONTROL DEVICE

[75] Inventors: Katzuhiko Eguchi, Kariya; Kazumi Ogawa, Toyota, both of Japan

[73] Assignee: Aisin Seiki Kabushiki Kaisha, Aichi-pref., Japan

[21] Appl. No.: 09/298,907

[22] Filed: Apr. 26, 1999

[30] Foreign Application Priority Data

Apr. 27, 1998 [JP] Japan ..... 10-116993

[51] Int. Cl.[7] ..... F01L 1/344; F01L 13/00

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,738,056 | 4/1998 | Mikame et al. | 123/90.17 |
| 5,823,152 | 10/1998 | Ushida | 123/90.17 |
| 5,845,615 | 12/1998 | Nakamura et al. | 123/90.17 |
| 5,901,674 | 5/1999 | Fujiwaki | 123/90.17 |
| 5,924,395 | 7/1999 | Moriya et al. | 123/90.15 |

FOREIGN PATENT DOCUMENTS 1-92504 4/1989 Japan .

9-250310 9/1997 Japan .

*Primary Examiner*—Weilun Lo

*Attorney, Agent, or Firm*—Reed Smith Hazel & Thomas LLP

[57] ABSTRACT

A valve timing control device incorporates a rotary shaft rotatably assembled within a cylinder head of an internal combustion engine, a rotational transmitting member mounted around the peripheral surface of the rotary shaft so as to rotate relative thereto within a predetermined range for transmitting a rotational power from a crank shaft, a vane provided on either one of the rotary shaft and the rotational transmitting member, a pressure chamber formed between the rotary shaft and the rotational transmitting member, and divided by the vane into an advance chamber and a delay chamber, a first fluid passage for supplying and discharging a fluid to and from the advance chamber, a second fluid passage for supplying and discharging a fluid to and from the delay chamber, a locking mechanism for holding the relationship between the rotary shaft and the rotational transmitting member at a middle position of the predetermined range, when the internal combustion engine starts, and a controlling mechanism for restricting the rotational transmitting member to rotate around the rotary shaft within a range between the middle position and an end position of the predetermined range.

6 Claims, 4 Drawing Sheets

VALVE TIMING CONTROL DEVICE

FIELD OF THE INVENTION

The present invention relates to a valve timing control device and, in particular, to the valve timing control device for controlling an angular phase difference between a crank shaft of a combustion engine and a cam shaft of the combustion engine.

BACKGROUND OF THE INVENTION

A conventional valve timing control device comprises: a rotational shaft for opening and closing a valve; a rotational transmitting member rotatably mounted on the rotational shaft; a vane provided on the rotational shaft; a pressure chamber formed between the rotational shaft and the rotational transmitting member and divided by the vane into an advance chamber and a delay chamber; a first fluid passage communicated with the advance chamber for supplying and discharging a fluid; a second fluid passage communicated with the delay chamber for supplying and discharging the fluid; and a locking member for maintaining a relative position between the rotational shaft and the rotational transmitting member. Such a conventional variable timing device is disclosed, for example, in Japanese Patent Laid-Open Publication No. H01-92504 and in Japanese Patent Laid-Open Publication No. H09-250310.

In the conventional valve timing control device, the valve timing is advanced due to relative displacement between the rotational shaft and the rotational transmitting member when the fluid is supplied to the advance chamber and is discharged from the delay chamber. On the contrary, the valve timing is delayed due to the counter displacement between the rotational shaft and the rotational transmitting member when the fluid is discharged from the advance chamber and is supplied to the delay chamber.

Further, in the conventional valve timing control device disclosed in the publications, the vane transmits the rotation from the rotational transmitting member to the rotational shaft. Therefore, the rotational shaft always receives a force which expands the delay chamber while the internal combustion engine is running. When the internal combustion engine is stalled, the rotational shaft rotates so as to expand the delay chamber due to lack of enough fluid supply to hold the vane at the current position. Thus, the rotational shaft reaches the most delayed position where the delay chamber is the largest. In case the internal combustion engine is cranked at the most delayed position of the rotational shaft, the vane vibrates due to unstable transitional pressure so as to generate undesirable noise. Conventionally, the locking member maintains the predetermined relative position between the rotational shaft and the rotational transmitting member so that generation of such vibration of the vane is effectively prevented.

Moreover, air intake tries to flow into a cylinder by inertia even after the piston begins to go to the top dead center while the internal combustion engine is running at high speed. Therefore, volumetric efficiency may be improved by delaying closure of an air-intake valve so that the output of the internal combustion engine may be improved.

However, in the conventional valve timing control device, the most delayed position has to be set so that the air intake is sufficient to crank the internal combustion engine. This means that the closing timing of the air-intake valve is not optimized for the high-speed operation of the internal combustion engine. Thus, the volumetric efficiency cannot be improved by the inertia of the air intake. If the closing timing of the air intake valve is unreasonably optimized for the high-speed operation of the internal combustion engine, the air intake which is at first inhaled into the cylinder flows backward upon start of the internal combustion engine since the air intake does not have enough inertia and the air-intake valve continues to be opened even after the piston passes the bottom dead center and begins to go to the top dead center. Therefore, the internal combustion engine becomes hard to crank due to insufficient compression ratio and imperfect combustion. Further, in the conventional valve timing control device, due to low atmospheric pressure, a similar disadvantage may be expected at high altitudes if the air intake valve is set to be closed at around the bottom dead center of the piston.

Further, in the conventional valve timing control device, if the exhaust valve timing is similarly delayed, the amount of exhaust gas recirculating is increased by an extended overlapping time of the air-intake valve and the exhaust valve so that the internal combustion engine becomes hard to start.

SUMMARY OF THE INVENTION

The invention has been conceived to solve the above-specified problems. According to the invention, there is provided a valve timing control device comprising: a rotary shaft rotatably assembled within a cylinder head of an internal combustion engine; a rotational transmitting member mounted around the peripheral surface of the rotary shaft so as to rotate relative thereto within a predetermined range for transmitting rotational power from a crank shaft; a vane provided on either the rotary shaft or the rotational transmitting member; a pressure chamber formed between the rotary shaft and the rotational transmitting member, and divided by the vane into an advance chamber and a delay chamber; a first fluid passage for supplying and discharging a fluid to and from the advance chamber; a second fluid passage for supplying and discharging a fluid to and from the delay chamber; a locking mechanism, for holding the relationship between the rotary shaft and the rotational transmitting member at a middle position of the predetermined range, when the internal combustion engine starts; and a controlling mechanism for restricting the rotational transmitting member to rotate around the rotary shaft within a range between the middle position and an end position of the predetermined range.

Other objects and advantages of invention will become apparent during the following discussion of the accompanying drawings.

BRIEF DESCRIPTION OF THE DRAWINGS

The foregoing and additional features of the present invention will become more apparent from the following detailed description of embodiments thereof when considered with reference to the attached drawings, in which.

DETAILED DESCRIPTION OF THE PREFERRED EMBODIMENTS

A valve timing control device in accordance with preferred embodiments of the present invention will be described with reference to the attached drawings.

Figure 1:
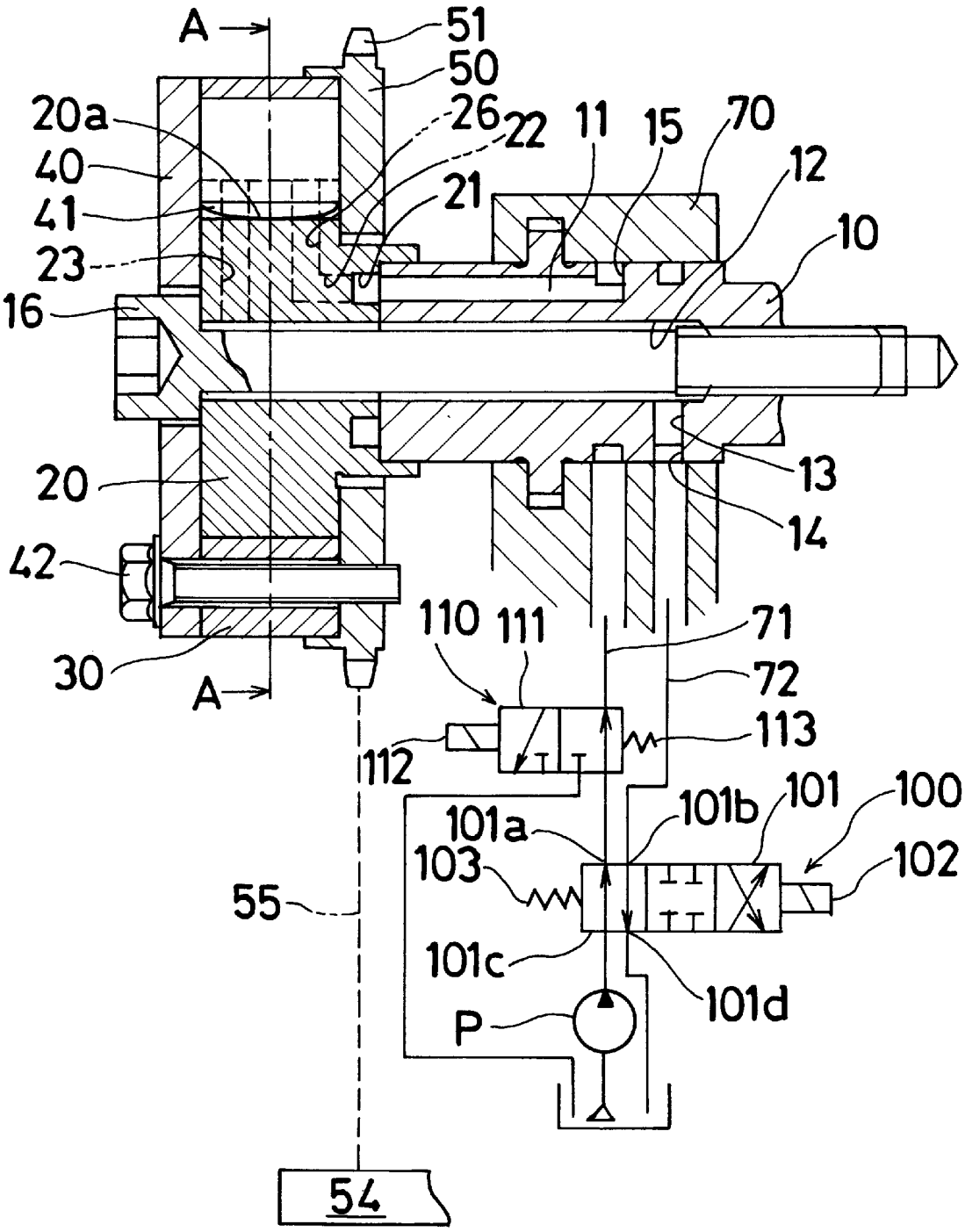
FIG. 1 is a sectional view of a first embodiment of a valve timing control device in accordance with the present invention.

A valve timing control device according to the present invention, as shown in FIGS. 1 though 5, is constructed so as to comprise a valve opening and closing shaft including a cam shaft 10 rotatably supported by a cylinder head 70 of an internal combustion engine, and an internal rotor 20 integrally provided on the leading end portion of the cam shaft 10; a rotational transmitting member mounted around the internal rotor 20 so as to rotate relative thereto within a predetermined range and including an external rotor 30, a front plate 40, a rear plate 50 and a timing sprocket 51 which is integrally formed around the rear plate 50; four vanes 60 assembled with the internal rotor 20; a locking mechanism 80 assembled with the external rotor 30; and a controlling mechanism 90 assembled with the external rotor 30. Here, the timing sprocket 51 is constructed, as is well known in the art, to transmit the rotating power to the clockwise direction of FIGS. 2 through 5 from a crankshaft 54 via a timing chain 55.

The cam shaft 10 is equipped with a well-known cam (not shown) for opening and closing an intake valve (not shown) and is provided therein with a delay passage 11 and an advance passage 12, which are extended in the axial direction of the cam shaft 10. The advance passage 12, which is disposed around a bolt 16, is connected to a connection port 101*b* of a control valve 100 via a radial passage 13, an annular passage 14 and a connection passage 72. On the other hand, the delay passage 11 is connected to a connection port 101*a* of the control valve 100 via an annular passage 15, a connection passage 71 and a changeover valve 110.

The control valve 100 includes a solenoid 102, a spool 101 and a spring 103. In FIG. 1, the solenoid 102 drives the spool 101 leftward against the spring 103 when the solenoid 102 is energized. In the energized state, the control valve 100 connects an inlet port 101*c* to the connection port 101*b* and also connects the connection port 101*a* to a drain port 101*d*. On the contrary, in the normal state, the control valve 100 connects the inlet port 101*c* to the connection port 101*a* and also connects the connection port 101*b* to the drain port 101*d*, as shown in FIG. 1. The solenoid 102 of the control valve 100 is energized by an electronic controller (not shown). As a result, operational fluid (working oil) is supplied to the delay passage 11 when the solenoid 102 is deenergized, and to the advance passage 12 when the solenoid 102 is energized. Because of duty ratio control of the electronic controller, the spool 101 may be linearly controlled so as to be retained at various intermediate positions. All the ports 101*a*, 101*b*, 101*c* and 101*d* are closed while the spool 101 is retained at the intermediate position.

The changeover valve 110 includes a solenoid 112, a spool 111 and a spring 113. In FIG. 1, the solenoid 112 drives the spool 111 rightward against the spring 113 when the solenoid 112 is energized. In the normal state, the changeover valve 110 connects the connection port 101*a* to the delay passage 11 via the connection passage 71. On the contrary, in the energized state, the changeover valve 110 closes between the connection port 101*a* and the delay passage 11 and connects the delay passage 11 to an oil pan 105 via the connection passage 71. The solenoid 112 of the changeover valve 110 is also energized by the electronic controller (not shown).

Figure 2:
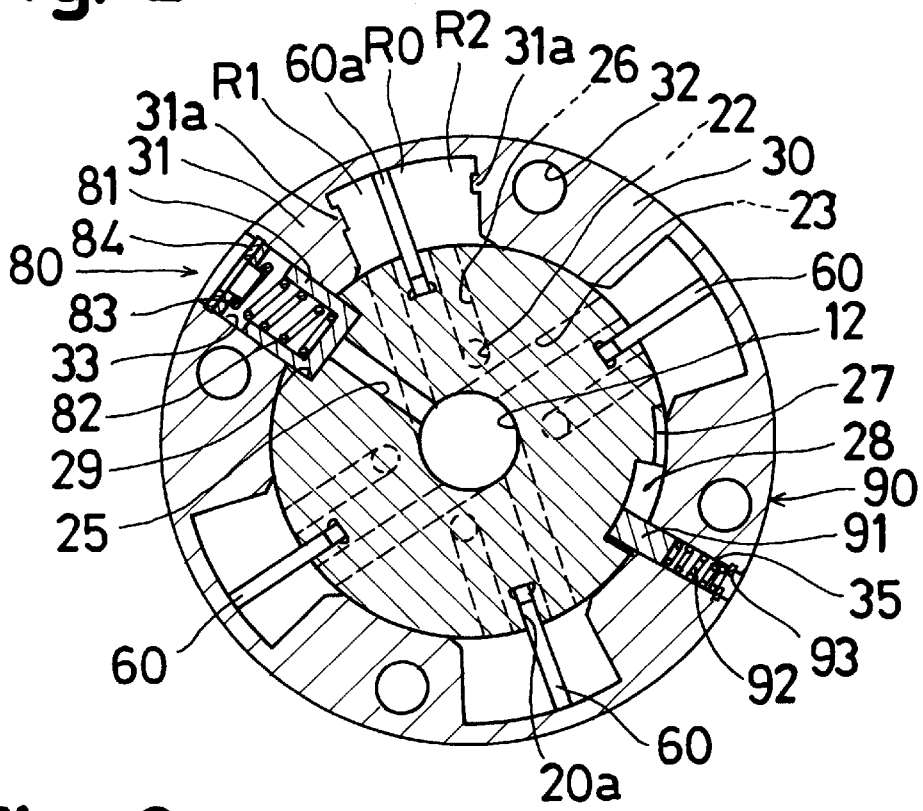
FIG. 2 is a section taken along the line A—A in FIG. 1 when a locking mechanism holds the rotary shaft and the rotational transmitting member at a middle position.
Figure 5:
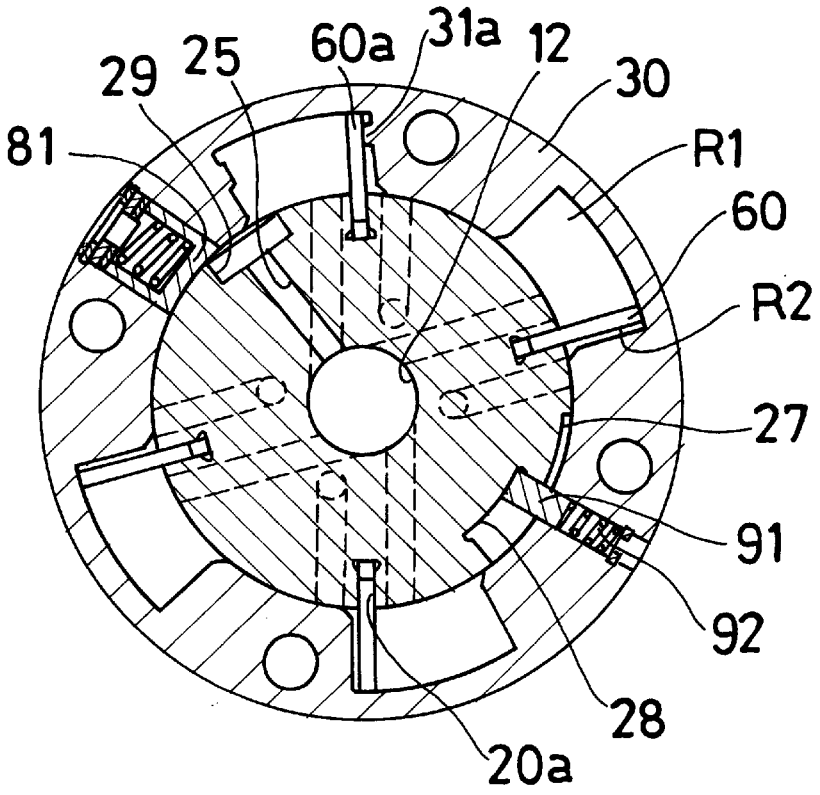
FIG. 5 is a view similar to FIG. 2 but showing the most advanced position.

The internal rotor 20 is integrally fixed in the cam shaft 10 by means of the bolt 16 and is provided with four vane grooves 20*a* for providing the four vanes 60 individually in the radial directions. Further provided are a fitting hole 29 for fitting a top portion of a locking pin 81 to a predetermined extent in the state shown in FIG. 2, where the cam shaft 10, the internal rotor 20 and the external rotor 30 are in a synchronized phase (the vanes 60 are in the middle position of a chamber R0) relative to one another; a passage 25 for supplying and discharging the operational fluid to and from the fitting hole 29 via the advance passage 12; four passages 23 for supplying and discharging the operational fluid to and from advancing chambers R1, as defined by the individual vanes 60 via the advance passage 12; a circle groove 21 which communicates with the delaying passage 11; four connecting passages 22 which are formed in the axis direction of the bolt 16 and each of which communicates with the circle groove 21; and four passages 26 for supplying and discharging the operational fluid to and from delaying chambers R2, as defined by the individual vanes 60 via the delaying passage 11, the circle groove 21 and the connecting passage 22. The fitting hole 29 is disposed on the peripheral surface of the internal rotor 20 and is extended in the radial direction of the internal rotor 20. In addition, there is a connecting groove 28 on the peripheral surface of the internal rotor 20. The connecting groove 28 is a member of the controlling mechanism 90. When the locking mechanism 80 prevents the internal rotor 20 from rotating relative to the external rotor 30 as shown in FIG. 2, a top portion of a connection pin 91 can insert into one end portion of the connecting groove 28. On the other hand, when the internal rotor 20 with the vanes 60 and the cam shaft 10 are at the most advanced position relative to the external rotor 30, the front plate 40 and the rear plate 50 as shown in FIG. 5, the top portion of the connection pin 91 can insert into the other end portion of the connecting groove 28. In addition, there is a communication groove 27 which communicates between the connecting groove 28 and the adjacent delay chamber R2, when the internal rotor 20 and the vanes 60 are at between the middle position and the most delayed position relative to the external rotor 30, the front plate 40 and the rear plate 50. Here, each vane 60 is urged radially outward by a vane spring (not shown) fitted in the bottom portion of the vane groove 20*a*.

The external rotor 30 is so assembled with the outer circumference of the internal rotor 20 as to rotate relative thereto within a predetermined range. To the two sides of the external rotor 30, there are joined the front plate 40 and the rear plate 50 by means of four bolts (not shown), each of which goes through a penetrating passage 32 of the external rotor 30. Further, four radial projections 31 are formed inwardly in the external rotor 30. Tops of the radial projections 31 touch the internal rotor 20 so that the external rotor 30 rotates around the internal rotor 20. The locking pin 81 and a spring 82 are contained in a bore 33 that is formed in one of the radial projections 31. The bore 33 extends in radial direction of the external rotor 30. In addition, there is another bore 35 that is formed in another of the radial projections 31. The bore 35 is symmetrically placed about the axis of the internal rotor 20. The bore 35 contains the connection pin 91 and a spring 92. The bore 35 also extends in radial direction of the external rotor 30.

Figure 3:
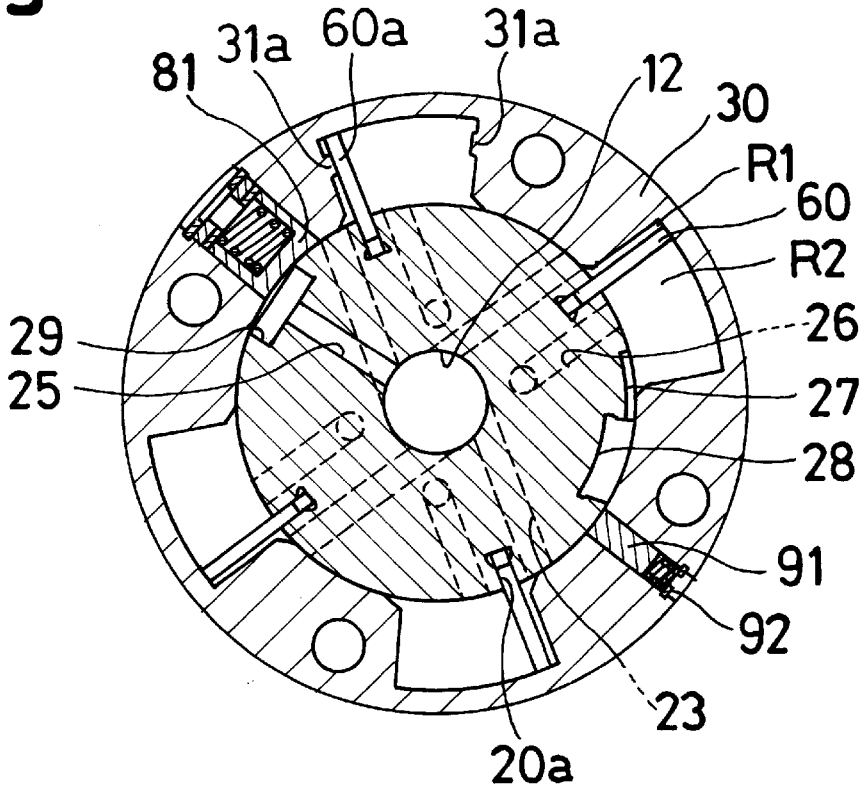
FIG. 3 is a view similar to FIG. 2 but showing the most delayed position.

Each vane 60 has a rounded edge that touches the external rotor 30 in fluid tight manner. Each vane 60 also touches both the plates 40 and 50 in fluid tight manner. The vanes 60 may slide in the vane grooves 20*a* in the radial direction of the internal rotor 20. Each vane 60 divides each of the pressure chambers R0 into the advance chamber R1 and the delay chamber R2. The pressure chambers R0 are formed by the external rotor 30, the radial projections 31, the internal rotor 20, the front plate 40 and the rear plate 50. As shown in FIGS. 2 through 5, in order to limit the relative rotation between the internal rotor 20 and the external rotor 30 within a predetermined range, one of the vanes 60 (a vane 60*a* which is described at upper left in FIG. 2) touches the adjacent radial projections 31*a* at the most advanced and delayed positions. In other words, as shown in FIG. 3, the most delayed position is achieved when the upper left vane 60*a* touches a delayed side of the radial projection 31*a* due to the expanded delay chambers R2. On the contrary, as shown in FIG. 5, the most advanced position is achieved when the upper left vane 60*a* touches an advanced side of the radial projection 31*a* due to the expanded advance chambers R1.

The lock pin 81 is slidably inserted in the bore 33. The lock pin 81 is pushed toward the internal rotor 20 by a spring 82. The spring 82 is inserted between the lock pin 81 and a retainer 83. The retainer 83 is held in the bore 33 by a snap ring 84.

The connecting pin 91 is slidably inserted in the bore 35. The connecting pin 91 is pushed toward the internal rotor 20 by the spring 92. The spring 92 is inserted between the connecting pin 91 and a snap ring 93.

In the above embodiment, when each of the vanes 60 is in the middle position of the pressure chamber R0, the outer end of the fitting hole 29 corresponds with the inner end of the bore 33 such that the top of the locking pin 81 is projected in the fitting hole 29. In this state, the valve timing of the intake valve is controlled so as to be able to crank the internal combustion engine. Further, when the relative phase between internal rotor 20 with the vanes 60 and the external rotor 30 is from the middle position to the most advanced position, the top of the connecting pin 91 which is disposed in the bore 35 is projected in the groove 28.

In the above embodiment, the sum of pressures in the advance chamber E1 balances with the sum of the pressures in the delay chambers R2 and a rotational counter torque of the pressure chambers R0 results when predetermined fluid pressures are supplied to the advance chamber R1 and the delay chamber R2 after start of the internal combustion engine. When the external rotor 30 is rotated, the rotational counter force is always applied to the vanes 60 toward the most delayed position since the pressure chambers R0 and the vanes 60 are in the torque transmission path between the external rotor 30 and the internal rotor 20. In accordance with various conditions of the internal combustion engine, the control valve 100 is controlled to change the balance. The operational fluid (working oil) is supplied to the advance chambers R1 through the advance passage 12 and passages 23, and is discharged from the delay chambers R2 through the passages 26, the connecting passages 22, the circle groove 21 and the delay passage 11 when the duty ratio is increased to energize the control valve 100 is energized. The internal rotor 20 with the vanes 60 rotates toward the most advanced position (clockwise direction in FIGS. 2 through 5) relative to the external rotor 30, the front plate 40 and the rear plate 50 when the operational fluid is supplied to the advance chambers R1 and is discharged from the delay chambers R2. The relative rotation of the internal rotor 20 with the vanes 60 is limited by the upper left vane 60*a* and the radial projection 31*a* as shown in FIG. 5. Further, the operational fluid is supplied to the delay chambers R2 through the passages 26, the connecting passages 22, the circle groove 21 and the delay fluid passage 11, and is discharged from the advance chambers R1 through advance passage 12 and passages 23 when the duty ratio is decreased to deenergize the control valve 100. The internal rotor 20 and the vanes 60 rotate toward the most delayed position (counterclockwise direction in FIGS. 2 through 5) relative to the external rotor 30, the front plate 40 and the rear plate 50 when the operational fluid is supplied to the delay chambers R2 and is discharged from the advance chambers R1. The relative rotation of the internal rotor 20 with the vanes 60 is also limited by the upper left vane 60*a* and the radial projection 31*a* as shown in FIG. 3. A predetermined pressure is applied to the fitting hole 29 via the passage 25, except when the relative phase between the internal rotor 20 with the vanes 60 and the external rotor 30 is in the most delayed position. Due to the applied pressures to the locking pin 81, the locking pin 81 is moved toward the spring 82 so that the locking pin 81 disengages from the fitting hole 29. In addition, the operational fluid is also supplied to the connecting groove 28 from the adjacent delay chamber R2 via the communication groove 27, when the relative phase between the internal rotor 20 with the vanes 60 and the external rotor 30 is between the most delayed position and the middle position. Due to the applied pressure to the connection pin 91, the connection pin 91 is moved toward the spring 92 so that the connection pin 91 disengages from the connecting groove 28. Here, during the above operations, the solenoid 112 of the changeover valve 110 is not energized such that the connecting port 101*a* of the control valve 100 connects to the delay passage 11 via the connection passage 71.

In the above embodiment, the bore 33 is coaxial to the fitting hole 29 while the vanes 60 are at the middle of the pressure chamber R0 as shown in FIG. 2. At this position, the valve timing is set for optimal starting of the internal combustion engine. Therefore, the valve timing may be further delayed up to the most delayed position as shown in FIG. 3. Thus, for the high-speed operation of the internal combustion engine, the control valve 100 is controlled to further delay the valve timing. The volumetric efficiency can be improved by the inertia of the air intake under high-speed operation of the internal combustion engine so that higher output can be obtained.

When the internal combustion engine is stalled, oil pump P is no longer driven by the internal combustion engine and the solenoid 102 of the control valve 100 is not energized so that the pressure chamber R0 no longer receives the operational fluid. At this time, neither the pressure in the advance chamber R1 nor the pressure in the delay chambers R2 is applied to the vanes 60, but only the rotational counter force is applied to the vanes 60 toward the most delayed position until the crankshaft 54 of the internal combustion engine is completely stopped. The relative position between the internal rotor 20 and the external rotor 30 is decided according to the relative position therebetween just before the internal combustion engine stalls.

At this time, if the bore 33 is coaxial to the fitting hole 29, the top portion of the connection pin 91 is projected in the connecting groove 28 so as to prevent the internal rotor 20 with the vanes 60 and the cam shaft 10 from rotating toward the delay side. Accordingly, the top portion of the locking pin 81 is projected in the fitting hole 29 so as to prevent the internal rotor 20 with the vanes 60 from rotating relative to the external rotor 30 as shown in FIG. 2.

If the bore 33 is positioned at the advance side from the above coaxial position between the bore 33 and the fitting hole 29, the internal rotor 20 with the vanes 60 and the cam shaft 10 is rotated toward the most delayed position by the above counter force. However, the rotation of the internal rotor 20 with the vanes 60 and the cam shaft 10 is restricted within the length of the communication groove 28, because the top portion of the connection pin 91 is projected in the communication groove 28. Due to the restriction of the rotation of the internal rotor 20 with the vanes 60 and the cam shaft 10, the rotation is stopped at the middle position. Accordingly, the top portion of the locking pin 81 is projected in the fitting hole 29 so as to prevent the internal rotor 20 with the vanes 60 from rotating relative to the external rotor 30 as shown in FIG. 2.

In the above embodiment, when a starter switch turns on to crank the internal combustion engine, the solenoid 112 of the changeover valve 110 is energized for a predetermined period such that the delay passage 11 connects to the oil pan 105 via the connection passage 71. Further, when the internal combustion engine cranks, the solenoid 102 of the control valve 100 is not energized such that both the advance chambers R1*a* and the delay chambers R2 are connected to the oil pan 105. As a result, when the internal combustion engine cranks, the internal rotor 20 with vanes 60 is easy to rotate (vibrate) relative to the external rotor 30 toward both the advance side and the delay side. However, just before the internal combustion engine stalls, if the relative position between the internal rotor 20 and the external rotor 30 is either when the bore 33 and the fitting hole 29 are at the coaxial position or when the bore 33 is positioned at the advance side from the above coaxial position between the bore 33 and the fitting, hole 29, the top portion of the locking pin 81 is projected in the fitting hole 29 so as to prevent the internal rotor 20 with the vanes 60 from rotating (vibrating) relative to the external rotor 30.

Figure 4:
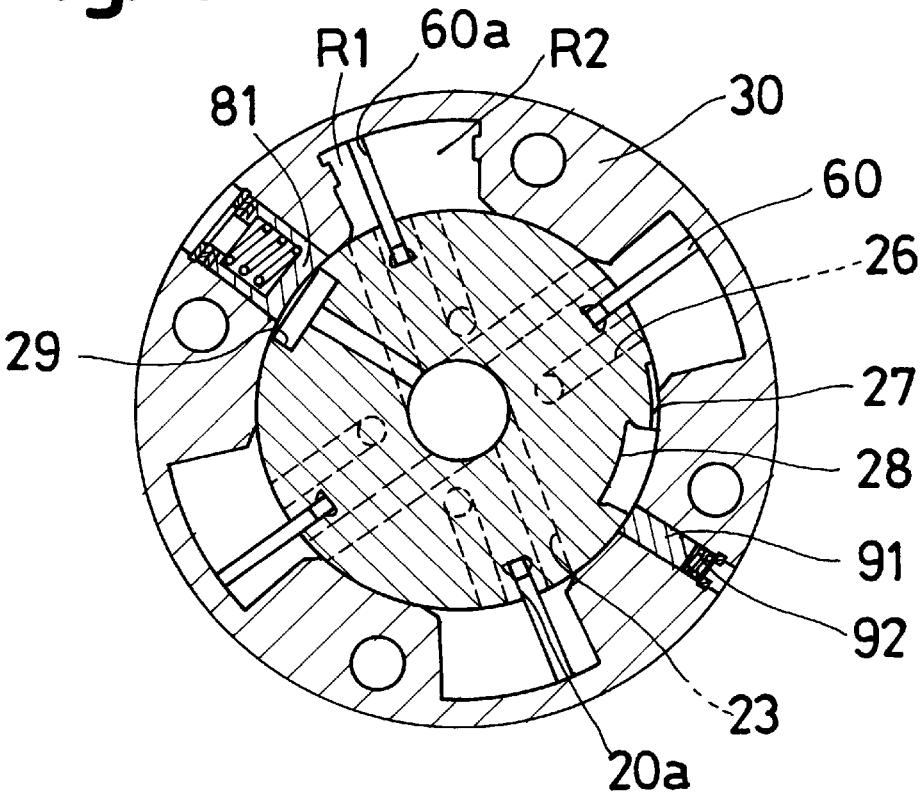
FIG. 4 is a view similar to FIG. 2 but showing another position between the most delayed position and the middle position.

Just before the internal combustion engine stalls, if the stepped bore 33 is positioned at the delay side from the above coaxial position between the bore 33 and the fitting hole 29, for example as shown in FIG. 4 or at the most delayed position as shown in FIG. 3, neither the top portion of the locking pin 81 nor the top portion of the connection pin 91 is projected in the fitting hole 29 or the connecting groove 28. If the internal combustion engine cranks in this state, the internal rotor 20 with the vanes 60 and the cam shaft 10 starts to rotate relative to the external rotor 30 to the delay direction by a torque variation, which is due to the action upon the cam shaft 10 at the cranking of the internal combustion engine, so as to make it difficult to crank the internal combustion engine. However, in the above embodiment, when a starter switch turns on the internal combustion engine, both the advance chambers R1 and the delay chambers R2 are connected to the oil pan 105 such that the internal rotor 20 with vanes 60 and the cam shaft 10 are easy to rotate (vibrate) relative to the external rotor 30 toward both the advance side and the delay side. When the internal rotor 20 with vanes 60 and the cam shaft 10 rotate (vibrate) relative to the external rotor 30 toward the advance side, the top of the connecting pin 91 is projected into the groove 28. As a result, the internal rotor 20 with vanes 60 and the cam shaft 10 is prevented from rotating relative to the external rotor 30 toward the delay side from the position where the coaxial position is between the bore 33 and the fitting hole 29. At the above coaxial position, the top portion of the locking pin 81 is projected into the fitting hole 29 so as to prevent the internal rotor 20 with vanes 60 and the cam shaft 10 from rotating relative to the external rotor 30.

Therefore, despite the large torque variation, the camshaft 10 and the internal rotor 20 rotate integrally with the external rotor 30 while the internal combustion engine is cranking. The vanes 60 cannot generate any undesirable noise since the vanes 60 are held at the middle of the pressure chamber R0 when the bore 33 becomes coaxial to the fitting hole 29.

According to the first embodiment of the present invention, no undesirable noise is generated at all while the internal combustion engine is cranking. Further, volumetric efficiency may be improved by delaying closure of an air-intake valve.

Figure 6:
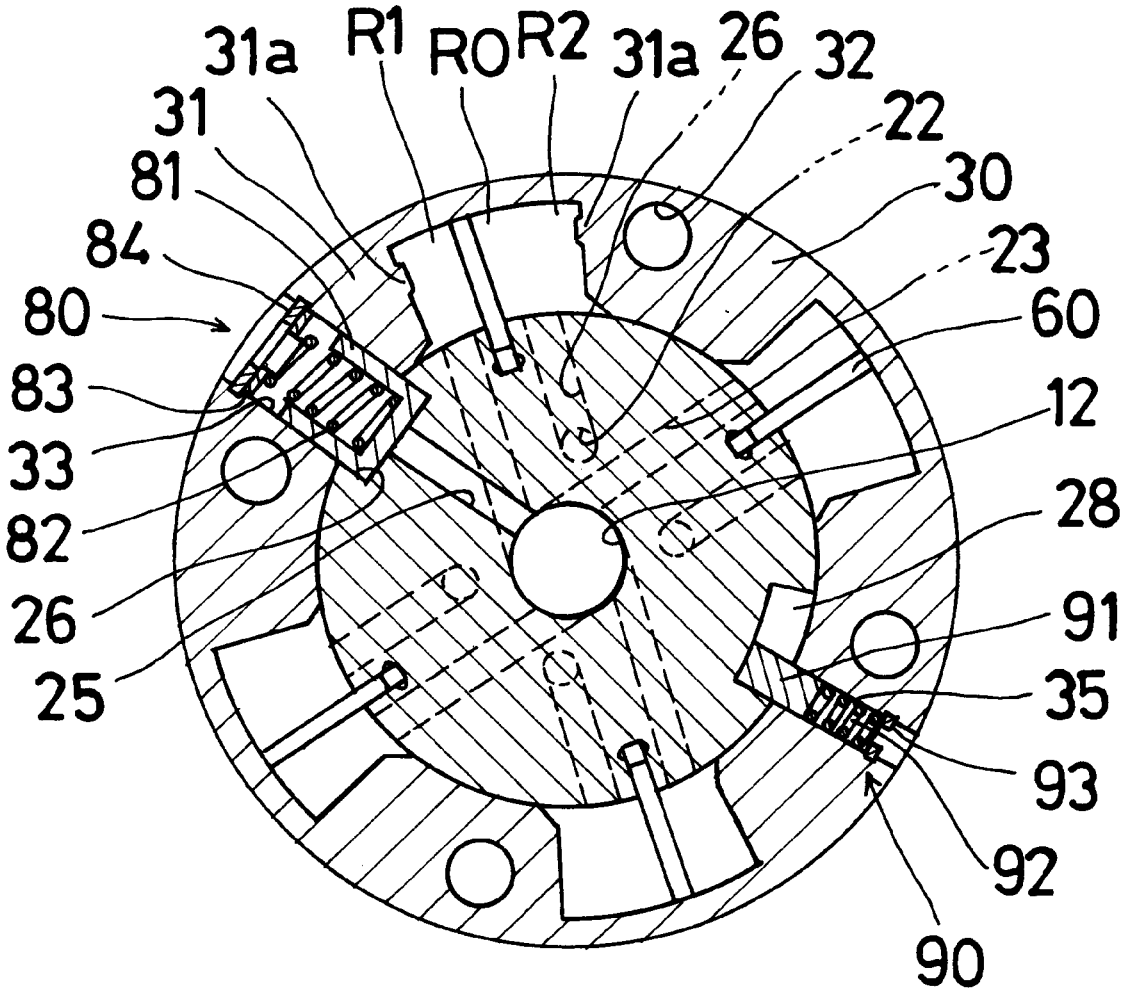
FIG. 6 is a view similar to FIG. 2 but showing a modified version of the first embodiment in accordance with the present invention.

FIG. 6 illustrates another modified version of the first embodiment, which specifically is a modified arrangement of the groove 28. In FIG. 6, the same parts in FIGS. 1 through 5 are used with the same numerals of FIGS. 1 through 5. In this modified construction, there is no communication groove which communicates between the connecting groove 28 and the adjacent delay chamber R2. The connection pin 91 can be moved into the bore 35 against the spring 92 by the centrifugal force of the external rotor 30. The weight of the connection pin 91 and the biased force of the spring 92 are set up so that the connection pin 91 can be moved into the bore 35 by the centrifugal force of the external rotor 30, when the rotational speed of the external rotor 30 is a predetermined speed which is less than the rotational speed of the external rotor 30 on the idling period of the internal combustion engine. Further, the above predetermined speed of the external rotor 30 is more than the rotational speed of the external rotor 30 on the cranking period of the internal combustion engine. In the above modified version, when the internal combustion engine is stopped or cranking, the top portion of the connection pin 91 is projected in the groove 28 so as to prevent the internal rotor 20 with the vanes 60 and the cam shaft 10 from rotating relative to the external rotor 30, such as described in the first embodiment.

In the above embodiments, the bore 35, the fitting hole 29 and the bore 33 are located in the radial direction of the camshaft 10, and the locking pin 81 and the connection pin 91 are moved in the same direction. However, this invention may be adapted to another type of valve timing control device. For example, in the arc direction, the thickness of the vanes are heavy and the vanes are integrally provided on the internal rotor. The bore, which is disposed within the locking pin, is located on either one of the end wall of the vane or the front plate (or rear plate). The fitting hole, which is projected in the locking pin, is located on the other one. Accordingly, the moving direction of the locking pin is the same as an axis direction of the cam shaft.

Further, in the above embodiments, the locking pin 81 is moved into the bore 33 by the operational oil which is supplied to the advance chamber R1 via the passage 25. However, this invention may be adapted to another locking pin. For example, the locking pin is a stepped pin which includes a small diameter portion and a large diameter portion. At the small diameter portion, the operational oil is supplied from either one of the adjacent advance chamber R1 or the adjacent delay chamber R2. At the large diameter portion, the operational oil is supplied from the other chamber. Accordingly, when the operational oil is supplied to either chamber, the locking pin is not projected in the bore.

Further, in the above embodiment, the cam shaft 10 drives the air intake valves of the internal combustion engine. However, this invention may be adapted to another cam shaft that drives the exhaust valves of an internal combustion engine.

What is claimed is:

1. A valve timing control device comprising:

a rotary shaft rotatably assembled within a cylinder head of an internal combustion engine;

a rotational transmitting member mounted around the peripheral surface of the rotary shaft so as to rotate relative thereto within a predetermined range for transmitting a rotational power from a crank shaft;

a vane provided on either of the rotary shaft or the rotational transmitting member;

a pressure chamber formed between the rotary shaft and the rotational transmitting member, and divided by the vane into an advance chamber and a delay chamber;

a first fluid passage for supplying and discharging a fluid to and from the advance chamber;

a second fluid passage for supplying and discharging a fluid to and from the delay chamber;

a locking mechanism for holding the rotary shaft and the rotational transmitting member at a middle position of the predetermined range, when the internal combustion engine starts; and a controlling mechanism for restricting the rotational transmitting member from rotating around the rotary shaft within a range between the middle position and an end position of the predetermined range.

2. A valve timing control device according to claim 1, wherein the end position is at the most advanced position of the rotary shaft relative to the rotational transmitting member.

3. A valve timing control device according to claim 1, wherein the controlling mechanism includes:

a connecting pin;

a refuge hole formed in either the rotational transmitting member or the rotary shaft for accommodating therein the connecting pin spring-biased toward the other of the rotary shaft and the rotational transmitting member; and a groove formed in the either the rotary shaft or the rotational transmitting member for fitting therein a top portion of the connecting pin.

4. A valve timing control device according to claim 3, wherein the controlling mechanism further includes a third fluid passage communicating the groove with the pressure chamber such that the connecting pin is moved into the refuge hole.

5. A valve timing control device comprising:

a rotary shaft rotatably assembled within a cylinder head of an internal combustion engine;

a rotational transmitting member mounted around the peripheral surface of the rotary shaft so as to rotate relative thereto within a predetermined range for transmitting a rotational power from a crank shaft;

a vane provided on either one of the rotary shaft and the rotational transmitting member;

a pressure chamber formed between the rotary shaft and the rotational transmitting member, and divided into an advance chamber and a delay chamber by the vane; a first fluid passage for supplying and discharging a fluid to and from the advance chamber;

a second fluid passage for supplying and discharging a fluid to and from the delay chamber;

a locking mechanism for holding the vane in the middle position of the pressure chamber, when the internal combustion engine starts; and a controlling mechanism for restricting the vane to move within a range between the middle position and an end position of the predetermined range.

6. A valve timing control device according to claim 5, wherein the end position is at the most advanced position of the vane.

* * * * *

UNITED STATES PATENT AND TRADEMARK OFFICE

CERTIFICATE OF CORRECTION

PATENT NO. : 6,053,139
DATED : April 25, 2000
INVENTOR(S) : Eguchi et al.

It is certified that error appears in the above-identified patent and that said Letters Patent is hereby corrected as shown below:

Item [75], please delete "Katzuhiko" and insert -- Katsuhiko --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*